United States Patent [19]

Conley et al.

[11] 4,143,689

[45] Mar. 13, 1979

[54] FLOW CONTROL FOR VAPOR RECOVERY NOZZLE

[75] Inventors: David H. Conley; James D. Whitmore, both of Conneaut, Ohio

[73] Assignee: Emco Wheaton Inc., Conneaut, Ohio

[21] Appl. No.: 770,818

[22] Filed: Feb. 22, 1977

[51] Int. Cl.[2] ..... B65B 3/18; B65B 57/14

[52] U.S. Cl. ..... 141/207; 141/208

[58] Field of Search ..... 141/128, 198, 206–229, 141/311 R, 346, 347, 392, 290, 302

[56] References Cited

U.S. PATENT DOCUMENTS

| | | | |
|---|---|---|---|
| 3,900,056 | 8/1975 | Giardini | 141/290 X |
| 3,982,571 | 9/1976 | Fenton | 141/207 X |
| 4,029,601 | 5/1977 | Hansel | 141/208 X |
| 4,031,930 | 6/1977 | Sutcliffe | 141/207 |

*Primary Examiner*—Richard E. Aegerter
*Assistant Examiner*—Frederick R. Schmidt
*Attorney, Agent, or Firm*—Fetherstonhaugh & Co.

[57] ABSTRACT

A vapor recovery liquid dispensing nozzle having a primary vent passage, a portion of which extends outwardly through the wall of the liquid discharge tube and a normally closed vent valve in the primary vent passage. The normally closed vent valve being located on the filling tube and having a vent valve member movable between a closed position closing the primary vent passage and an open position in which the primary vent passage is open. The shroud which surrounds the liquid discharge tube engages the vent valve member to move the vent valve member between the open and closed positions in response to movement of the shroud between its extended position and its retracted position such that the primary vent passage is closed to prevent the flow of liquid through the filling tube when the shroud is extended and is open to permit the flow of liquid through the filling tube when the shroud is retracted.

11 Claims, 5 Drawing Figures

FLOW CONTROL FOR VAPOR RECOVERY NOZZLE

FIELD OF INVENTION

This invention relates to a vapour recovery liquid dispenser nozzle.

RELATED APPLICATIONS

A dispenser nozzle similar to the nozzle of the present invention is described in U.S. Pat. No. 4,060,110 dated Nov. 29, 1977.

A related nozzle construction is also described in the applicant's U.S. Pat. No. 3,982,571 which issued Sept. 28, 1976.

In U.S. Pat. No. 3,982,571 a vent valve is located in the vent passage which extends between the end of the nozzle and the vacuum chamber of the vacuum activated release mechanism which renders the main valve inoperative. The mechanism employed for opening and closing the vent valve requires a substantial modification to the main body of the nozzle.

In U.S. Pat. No. 4,060,110 the mechanism for disrupting the vent line is located within the filling tube and includes magnetic members activated by a complementary magnetic member located on the shroud. Again this is a complex mechanism.

In the nozzle of the present invention the valve which interupts the normal operation of the vent line is located on the exterior of the discharge tube and is operated by contact with the shroud. This mechanism is simple and reliable in its operation.

It is, therefore, an object of the present invention to provide an improved vent passage disrupting mechanism.

According to one aspect of the present invention there is provided in a vapour recovery liquid dispensing nozzle of the type having a vacuum operated release mechanism for automatically closing the flow control valve when the level of liquid in the tank being filled thereby rises to a level closing the end of the primary vent passage of the vent tube, the vent tube extending through the liquid discharge passage which is formed in the liquid discharge tube of the nozzle, and an extensible vapour recovery shroud extending around the filling tube for directing vapour to the recovery passage in the body of the nozzle, the shroud being movable from an extended position to a retracted position when the liquid discharge tube is operatively located within a filling tube of a liquid storage tank with the vapour recovery passage thereof communicating with the tank by way of the shroud, the improvement wherein; said primary vent passage has a section which extends outwardly through the wall of the liquid discharge tube, a normally closed vent valve in said section of said primary vent passage, said vent valve being mounted on said filling tube and having a vent valve member movable between a closed position closing said primary vent passage and an open position which said primary vent passage is open, said shroud being adapted to engage said vent valve member to move said vent valve member between said first and second positions in response to movement of said shroud between said extended position and said retracted position whereby said primary vent passage is closed to prevent the flow of liquid through said filling tube when said shroud is extended and is open to permit the flow of liquid through said filling tube when said shroud is retracted.

The invention will be more clearly understood after reference to the following detailed specification read in conjunction with the drawings wherein.

Figure 1:
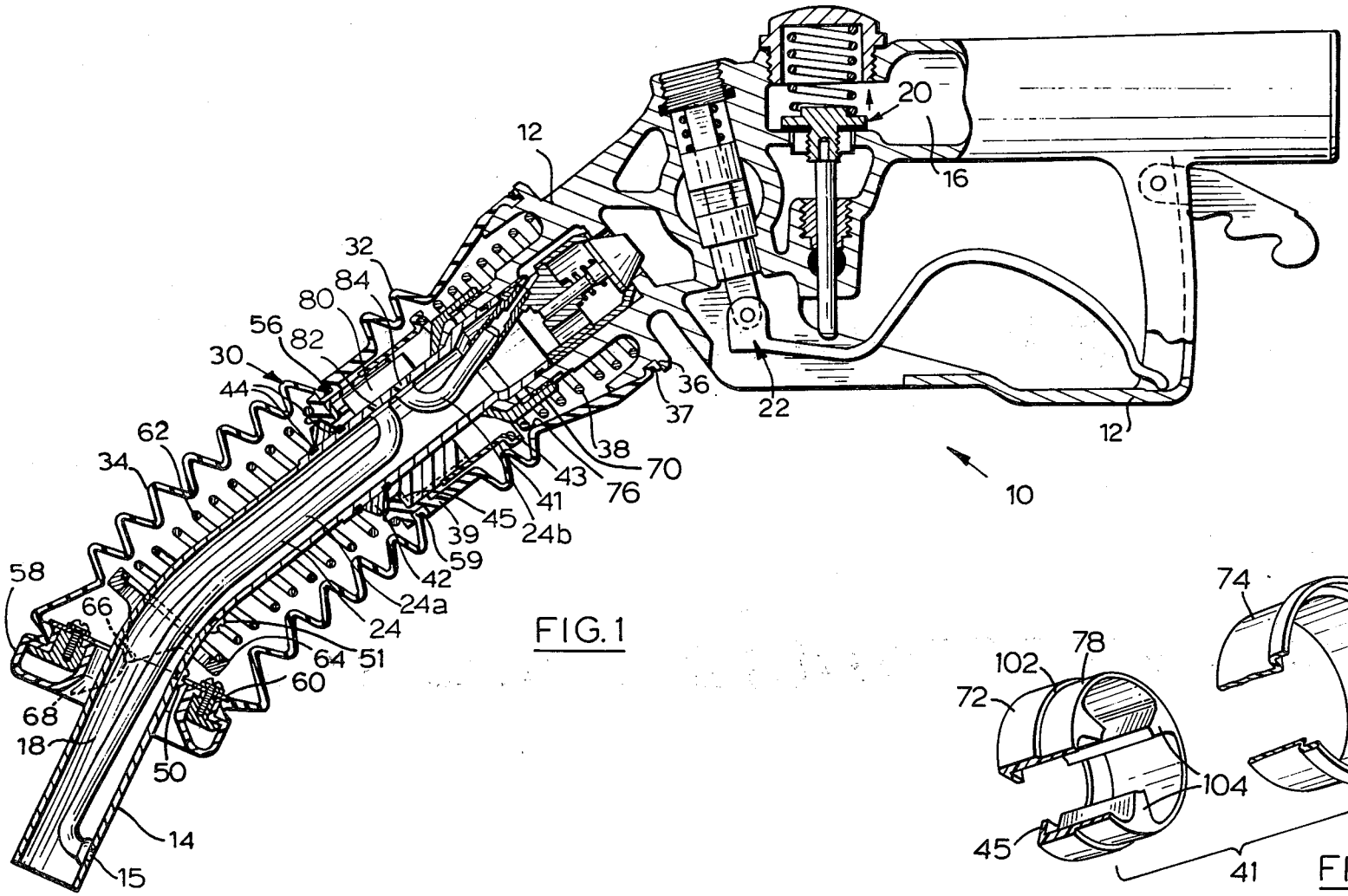
FIG. 1 is a partially sectioned side view of a vapour recovery nozzle according to an embodiment of the present invention.

With reference to FIG. 1 of the drawings, the reference numeral 10 refers generally to a vapour recovery dispenser nozzle according to an embodiment of the present invention. The nozzle consists of a main body portion 12 having a fluid discharge tube 14 extending from one end thereof. The main body 12 has a fluid passage generally identified by the reference numeral 16 extending therethrough which communicates with the fluid discharge passage 18 of the discharge tube 14. Main valve 20 is located in the passage 16 for opening and closing the passage 16 to regulate the flow of liquid therethrough. A releasable latching mechanism generally identified by the reference numeral 22 is vacuum operated to automatically close the valve 20 when normal venting of the vacuum mechanism by way of the vent tube 24 is interrupted. The structure described above is well known and is not, therefore, described in detail. A nozzle having a vacuum operated release mechanism of the type which may be incorporated in accordance with an embodiment of the present invention is described in U.S. Pat. No. 3,196,980.

In FIG. 1 of the drawings, the reference numeral 30 refers generally to a vapour recovery shroud. The vapour recovery shroud consists of a first portion 32 and a second portion 34. A first portion has its upper end located in a channel 36 formed in the main body portion. An annular sealing refers generally to a vapour recovery shroud. The vapour recovery shroud consists of a first portion 32 and a second portion 34. A first portion has its upper end located in a channel 36 formed in the main body portion. An annular sealing collar is formed as an intergral portion of the outer end of the inner portion 32 of the shroud. A cylindrical shaped shield 41 is located within the first portion 39 of the shroud.

Figure 4:
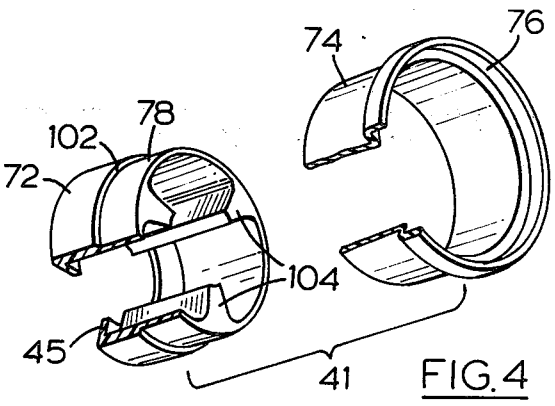
FIG. 4 shows the construction of the shield located within the shroud.
Figure 3:
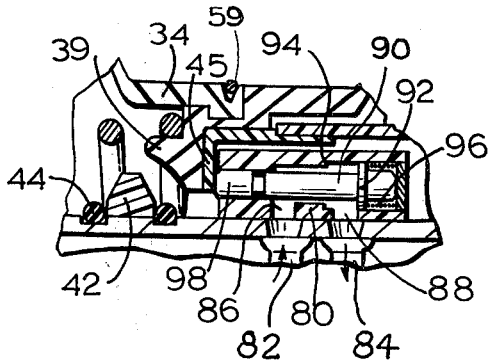
FIG. 3 is a sectional view through the vent valve in the open position showing the manner in which the valve is open in response to movement of the shroud.

As shown in FIG. 4 of the drawings, the shield 41 consists of portions 72 and 74. The portion 74 has a hollow cylindrical configuration and is formed with a recess 76 at one end thereof within which one end of a spring 38 is operatively located in use. The portion 72 has an end section 78 of reduced diameter adapted to fit within the cylindrical portion 74 so that the front end of the portion 74 rests against the shoulder 102 of the portion 72. A flange 45 projects radially inwardly from the front end of the portion 72 and, as shown in FIG. 3 of the drawings, the flange 45 engages the valve member 98.

The portion 72 has a plurality of ridges 104 projecting radially inwardly thereof. The ridges 104 rest against the outer surface of the discharge tube 14 and serve to space the shield outwardly therefrom in a position so as to protect the vent valve 80 as will be described hereinafter.

Referring once again to FIG. 1 of the drawings, it will be seen that the first compression spring 38 has its inner end bearing against the main body portion 12 and its outer end bearing against the shoulder 43 of the shield 41. The first portion 32 of the shroud is formed with a plurality of circumferentially extending corrugations such that it is readily extended or contracted as required in use. The first spring 38 serves to urge the first portion 32 of the shroud to its extended position shown in FIG. 1. The tubular shield 41 serves as a shield preventing inward deflection of the flexible shroud to protect the mechanism which is located therein and described hereinafter.

An annular sealing ring 42 is mounted on the discharge tube 14 and extends radially outwardly therefrom. O-rings 44 serve to secure the sealing ring 42 with respect to the discharge tube 14. The sealing collar 39 of the first portion 32 sealingly engages the sealing ring 42 when the first portion 32 of the shroud is in its extended position. The first spring 38 is designed to apply a sealing pressure to the sealing collars 39 when its is in engagement with the sealing ring 42 to prevent the passage of vapour through the shroud.

Figure 5:
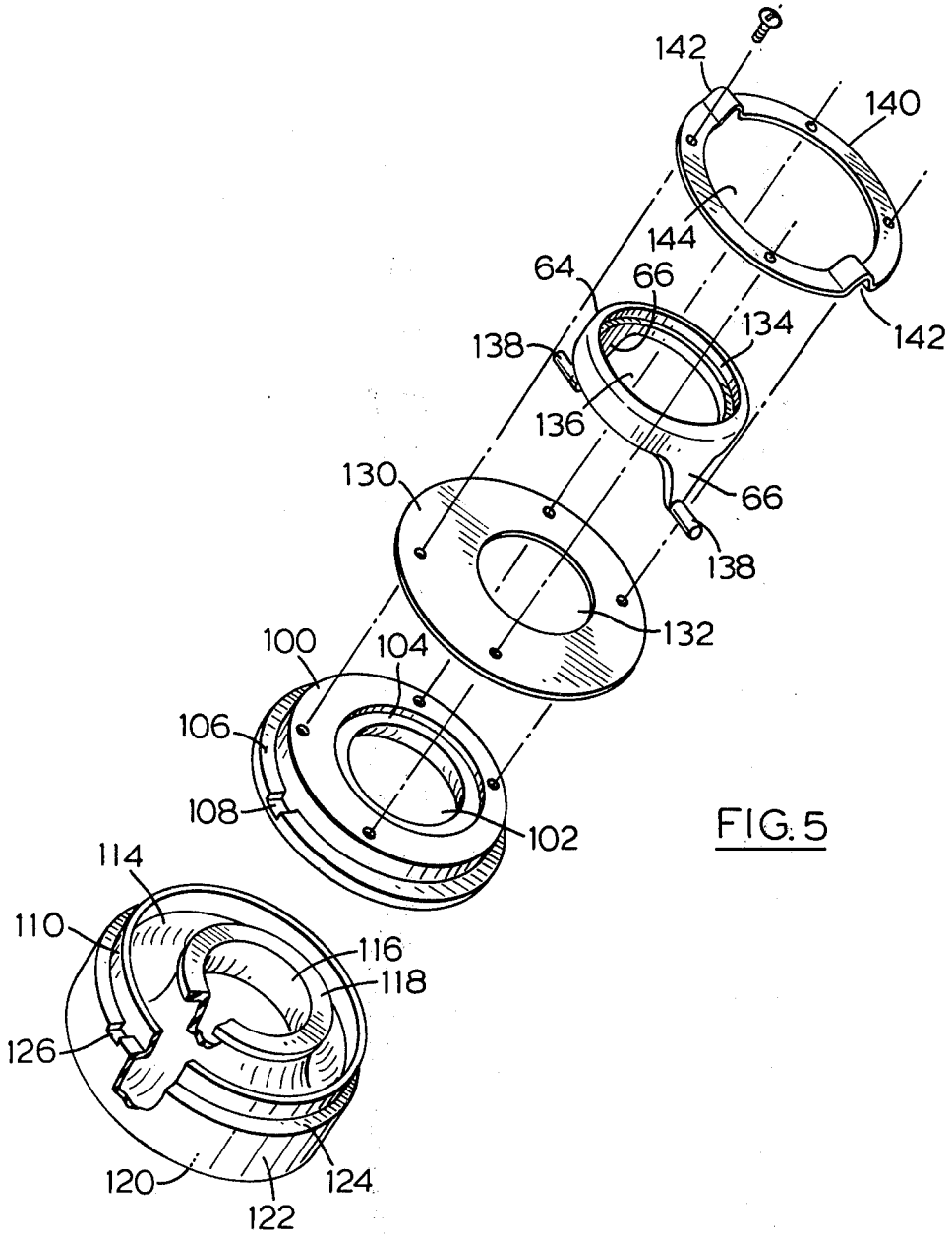
FIG. 5 illustrates the structure of the annular sealing ring.

The sealing relationship between the ring 42 and the collar 39 is such that when the first portion 32 of the shroud is fully extended and a seal is made between the sealing ring 42 and collar 39, recovered vapours which are located within the nozzle cannot escape to atmosphere through the open end of the shroud. The location of the sealing ring 42 is such that it is possible to mount the automatic nozzle in the filling tube of a gas tank of an automobile or the like in a self-supporting position with the sealing ring 42 located outwardly from the filling tube of the gas tank. A plurality of screw heads 50 and 51 project a short distance outwardly from the discharge tube by longitudinally spaced intervals along the outer end portion thereof to engage with the end of a filling neck of a gasoline storage tank of an automobile or the like so that the nozzle may be self-supporting by engagement with the gas tank. The second or outer portion 34 of the shroud has its inner end mounted in an annular recess formed at the outer end of the first portion 32. A clamping ring 59 serves to secure the inner end of the second portion 34 of the shroud with respect to the outer end of the first portion 32. The second portion 34 of the shroud has an annular sealing ring 58 at the outer end thereof. The structure of the annular sealing ring is illustrated in FIG. 5 of the drawings. As shown in FIG. 5 of the drawings, the sealing ring consists of a semi-rigid plastic ring 100 which has a through passage 102. A ledge 104 is located at the upper edge of the passage 102 and extends radially inwardly therefrom. A ledge 106 projects radially outwardly from the ring 10 and has a U-shaped notch 108 opening downwardly therefrom.

A readily replaceable soft rubber nose member 110 is adapted to be mounted on the ring 100. The nose member 110 has a thin rubber wall which defines an enclosure 114 adapted to receive the ring 100. A through passage 116 is formed in the nose member 110 is alignment with the through passage 102 of the ring 100. The wall of the nose member 110 includes a lip portion 118 adapted to extend into the recess 104 of the ring 100. The wall of the nose member 110 extends downwardly from the lip 118 to an end wall 120 and thereafter upwardly to form side wall 122. The side wall 122 is formed to provide an inwardly extending ledge 124 at the upper end thereof. The ledge 124 is adapted to extend over the ledge 106 of the ring 100. A small U-shaped recess 126 is formed in the upper face of the ledge 124 and a corresponding detent (not shown) projects inwardly from the outer wall 122 to register with the channel 108 in the ring 100. As shown in the drawings, the passages 102 and 116 are eccentrically located with respect to the external periphery of the ring and nose members respectively. The notch 108 and the detent formed by the inner surface of the recess 126 serve to ensure that the passages 102 and 116 are properly aligned in use. The recess 126 receives a complementary detent formed at the outer end of the second portion of the shroud.

A circular clamping plate 130 is mounted on the upper face of the ring 110 and serves to clamp the lip 118 on the ledge 104. The plate 130 has a through passage 132.

A support ring 64 has a circumferentially extending recess 134 located at the inner end thereof and a through passage 136 opening therethrough. A pair of support arms 66 project downwardly from the ring 64. Shafts 138 project radially outwardly from the lower ends of the arms 66. A mounting ring 140 is formed to provide a pair of shaft receiving channels 142 at diametrically opposite sides of the through passage 144 thereof. The channels 142 are proportioned to permit the shafts 138 to pivot therein. This structure permits the soft sealing ring to pivot about an axis extending transversely of the discharge tube to be aligned with the end of a filling tube of a gasoline tank in use.

As shown in FIG. 1 of the drawings, the first extension spring 38 serves to extend one portion of the shroud and the second extension spring 62 serves to extend the other portion of the shroud. The second extension spring 62 is stronger than the first extension spring 38 such that the first portion of the shroud 32 will extend into sealing engagement with the sealing ring 42 as soon as the nozzle begins to be removed from the tank in which it is located during the filling operation.

Figure 2:
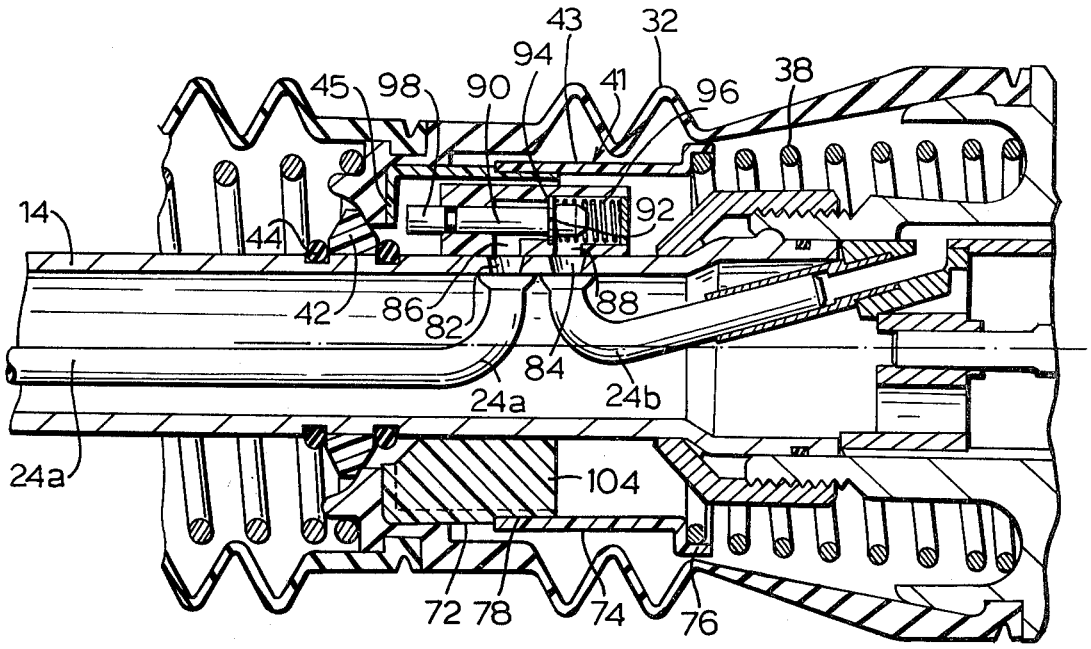
FIG. 2 is an enlarged sectional view of a portion of a nozzle showing the vent valve and its operating mechanism.

As is common in vacuum release latching mechanisms used in liquid dispenser nozzles, the vacuum drawn by the flow of liquid through the venturi mechanism is vented through vent line 24 until the level of liquid in the tank being filled by the nozzle rises above the lower end of the vent tube 24. A vent valve 80 is mounted on the discharge tube 14 inwardly of the shield member 41. The vent tube 24 has a first portion **24*a* and a second portion 24*b*. The outer end of the first portion 24*a* communicates with a vent passage 15 formed at the outer end of the liquid discharge tube 14. The inner end of the first portion 24*a* of the vent tube communicates with the passage 82 which opens through the wall of the discharge tube 14. The second portion 24*b* has one end communicating with the vacuum operated latch mechanism and its other end communicating with the passage 84 opening through the wall of the discharge tube 14. As shown in FIG. 2 of the drawings, the passages 82 and 84 communicate with the inlet and outlet passages 86 and 88 respectively of the vent valve 80. The vent valve 80 has a valve member 90 slidably mounted therein. The valve member 90 has a sealing ring 92 adapted to engage the valve seat 94 to close the valve in use. A spring 96 urges the valve member to a closed position. The valve member 90 has a portion 98 projecting outwardly from one end thereof. The radially inwardly directed flange 45 of the shield member is positioned as to engage the portion 98 of the valve member to move the valve member away from the closed position shown in FIG. 2 to the open position shown in FIG. 3 is response to compression of the first portion 32** of the shroud.

The nozzle according to the present invention will assume the position shown in FIG. 1 of the drawings when not in use. In this position, as previously described the shroud is in its extended condition and the vent valve 80 is closed. When the vent valve 80 is closed, the vent line for venting the vacuum operator latch mechanism is inoperative so that it is not possible to operate the main valve to provide a continuous flow of fluid through the discharge tube. Before the nozzle can be operated, it is necessary to locate the discharge tube 14 within the filling tube of the receptacle which is to be filled and to compress the shroud to an extent sufficient to move the first shroud portion 32 towards the valve member 90 to engage the valve member 90 to move the valve member 90 to the open position opening the vent line. Compression of the shroud is by engagement of the outer end of the shroud with the end of the filling tube and this serves to ensure that a seal is formed between the end seal 58 and the end of the filling tube which is being filled so that vapour which is vented through the filling tube of the tank passes through the shroud, past the sealing ring 42 and collar 39, and through the first shroud portion 32 to the conventional vapour recovery passages formed in the head of the nozzle. The vent passage will remain open until the level of liquid in the tank rises above the passage 15 or until the nozzle is removed from the filling tube. If the nozzle is removed from the filling tube, the shrouds extend to their original extended position in which the vent valve 80 is again closed.

From the foregoing, it will be apparent that the vent valve mechanism is a simple and effective mechanism for ensuring that the vapour recovery shroud of the nozzle is operatively located with respect to the filling tube of the tank which is being filled before the flow of liquid into the tank can be initiated.

The shield member 41 of a rigid plastic material provides a protective shield for the valve 80 which prevents damage to the valve resulting from inward deflection of the shroud as might otherwise occur if the nozzle is dropped, struck or strikes an object.

As shown in FIG. 1 of the drawings, a liquid discharge tube 14 is releasable from the main body of the nozzle 12 by releasing the threaded nut 70. Thus the liquid discharge tube and its associated vent valve 80 may be used as a replacement for a conventional vent system of the type described in U.S. Pat. No. 3,196,908. Similarly, the shroud of the present invention may be mounted on the main body of a nozzle of the type described in U.S. Pat. No. 3,196,908. Thus existing nozzles may be modified by replacing the existing liquid discharge tube with a liquid discharge tube constructed in accordance with the present invention and by the addition of a shroud constructed in accordance with the present invention. Thus existing nozzles may be upgraded to provide a vapour recovery system in which liquid cannot be discharged until a seal is formed between the tank which is to be filled and the vapour recovery shroud.

These and other advantages of the present invention will be apparent to those skilled in the art.

What we claim as our invention is:

1. In a vapour recovery liquid dispensing nozzle of the type having a main body portion and a liquid discharge tube and means releasably securing said liquid discharge tube to said main body, said liquid discharge tube projecting outwardly from said main body portion, the wall of said discharge tube having an exterior surface extending longitudinally thereof, a vacuum operated release mechanism in said main body for automatically closing the flow control valve when the level of liquid in the tank being filled thereby rises to a level closing the end of the primary vent passage of the vent tube, the vent tube extending through the liquid discharge passage which is formed in the liquid discharge tube of the nozzle, and an extensible vapour recovery shroud assembly extending around the liquid discharge tube for directing vapour to the recovery passage in the body of the nozzle, the shroud assembly being movable from an extended position to a retracted position by engagement with a filling tube when the liquid discharge tube is operatively located within a filling tube of a liquid storage tank with the vapour recovery passage thereof communicating with the tank by way of the shroud assembly, and extendable from the retracted position to the extended position by an extension spring assembly, the improvement wherein;

(a) said primary vent passage has a section which extends outwardly from said discharge passage through an opening in the wall of the liquid discharge tube and returns to the discharge passage through an opening in the wall of the liquid discharge tube, said openings being spaced outwardly from said main body, and (b) a normally closed vent valve in said section of said primary vent passage, said vent valve being mounted on and carried by said exterior surface of said liquid discharge tube and spaced a substantial distance from said main body, said vent valve having a vent valve member movable between a closed position closing said primary vent passage and an open position in which said primary vent passage is open, (c) said shroud assembly being adapted to engage said vent valve member to move said vent valve member between said first and second positions in response to movement of said shroud assembly between said extended position and said retracted position whereby said primary vent passage is closed to prevent the flow of liquid through said liquid discharge tube when said shroud assembly is extended and is open to permit the flow of liquid through said liquid discharge tube when said shroud assembly is retracted.

2. A vapour recovery liquid dispenser as claimed in claim 1 wherein said shroud assembly includes an extensible shroud member which is flexible and which flexes inwardly upon compression of said shroud assembly and an elongated cylindrical shaped incompressible shield member located within and mounted on said shroud member radially outwardly from said vent valve to prevent inward buckling of said shroud member when said shroud assembly is compressed and thereby protect said vent valve.

3. A vapour recovery liquid dispenser as claimed in claim 2 wherein said cylindrical shaped shield member has radially inwardly directed flange means which serve to permit the shroud assembly to engage said valve member.

4. A vapour recovery liquid dispensing nozzle as claimed in claim 1 wherein said shroud assembly includes a shroud member which has two extensible portions, namely, an outer portion which sealingly engages the end of a filling tube of a liquid storage tank and an inner portion which communicates with the vapour recovery passage in the body of the nozzle, said portions being connected by an intermediate portion located between the inner and outer portions, a sealing ring mounted on the discharge tube and projecting radially outwardly therefrom, annular collar means projecting radially inwardly from the intermediate portion, said annular collar means having a sealing face directed towards said sealing ring and a valve striking face directed towards said valve, said sealing ring engaging a sealing face of said annular collar means when said shroud assembly is in its extended position, said valve striking face of said sealing collar engaging said valve member to move said valve member as aforesaid to open and close said vent line in response to movement of said shroud from said extended position to said retracted position.

5. In a vapour recovery liquid dispensing nozzle of the type having a vacuum operated release mechanism for automatically closing the flow control valve when the level of liquid in the tank being filled thereby rises to a level closing the end of the primary vent passage of the vent tube, the vent tube extending through the liquid discharge passage which is formed in the liquid discharge tube of the nozzle, and an extensible vapour recovery shroud assembly extending around the liquid discharge tube for directing vapour to the recovery passage in the body of the nozzle, the shroud assembly being movable from an extended position to a retracted position by engagement with a filling tube when the liquid discharge tube is operatively located within a filling tube of a liquid storage tank with the vapour recovery passage thereof communicating with the tank by way of the shroud assembly, and extendable from the retracted position to the extended position by an extension spring assembly, the improvement wherein;

(a) said primary vent passage has a section which extends outwardly through the wall of the liquid discharge tube, and (b) a normally closed vent valve in said section of said primary vent passage, said vent valve being mounted on an exterior surface of said liquid discharge tube and having a vent valve member movable between a closed position closing said primary vent passage and an open position in which said primary vent passage is open, (c) said shroud assembly being adapted to engage said vent valve member to move said vent valve member between said first and second positions in response to movement of said shroud assembly between said extended position and said retracted position whereby said primary vent passage is closed to prevent the flow of liquid through said liquid discharge tube when said shroud assembly is extended and is open to permit the flow of liquid through said liquid discharge tube when said shroud assembly is retracted, said shroud assembly including a shroud member which has two extensible portions, namely, an outer portion which sealingly engages the end of a filling tube of a liquid storage tank and an inner portion which communicates with the vapour recovery passage in the body of the nozzle, said portions being connected by an intermediate portion located between the inner and outer portions, a sealing ring mounted on the discharge tube and projecting radially outwardly therefrom, annular collar means projecting radially inwardly from the intermediate portion, said annular collar means having a sealing face directed towards said sealing ring and a valve striking face directed towards said valve, said sealing ring engaging a sealing face of said annular collar means when said shroud assembly is in its extended position, said valve striking face of said sealing collar engaging said valve member to move said valve member as aforesaid to open and close said vent line in response to movement of said shroud from said extended position to said retracted position.

6. A vapour recovery liquid dispensing nozzle as claimed in claim 5, wherein said vent valve is located on said discharge tube at a position underlying said inner portion of said shroud, and wherein a cylindrical shaped shield member is located within said shroud member and radially outwardly from said vent valve, said shield preventing inward buckling of said shroud member in the area of said vent valve and thereby protecting said vent valve.

7. A vapour recovery liquid dispensing nozzle as claimed in claim 6, wherein said shield has a first and second end, said first end being mounted on said intermediate portion of said shroud and said second end being movable relative to said inner portion of said shroud as said shroud moves between its extended and retracted position.

8. A vapour recovery liquid dispensing nozzle as claimed in claim 7, wherein said second end of said shield is adapted to receive the end of a coil spring, a coil spring extending between said second end of said shield and said main body of said nozzle to urge said inner portion of said shroud member to its extended position.

9. A vapour recovery liquid dispensing nozzle as claimed in claim 5, wherein said vent valve is located on said discharge tube at a position underlying said inner portion of said shroud member and wherein a cylindrical shaped shield member is mounted on said shroud and located within said inner portion of said shroud radially outwardly from said vent valve to prevent inward buckling of said shroud and thereby protect said vent valve.

10. A vapour recovery liquid dispensing nozzle as claimed in claim 9, wherein said shield has a first end and a second end, said first end being mounted on said intermediate portion of said shroud and said second end being movable relative to said first portion of said shroud as said shroud moves between its extended and retracted position.

11. In a vapour recovery liquid dispensing nozzle of the type having a main body portion and a liquid discharge tube and means releasably securing said discharge tube to said main body with said liquid discharge tube projecting outwardly from the main body portion, the wall of said discharge tube having an exterior surface extending longitudinally thereof, a vacuum operated release mechanism in said main body for automatically closing the flow control valve when the level of liquid in the tank being filled thereby rises to a level closing the end of the primary vent passage of the vacuum operated release mechanism, the vent tube extending through the liquid discharge passage which is formed in the liquid discharge tube of the nozzle and an extensible vapour recovery shroud extending around the liquid discharge tube for directing vapour to the recovery passage of the nozzle, the shroud being movable from an extended position to a retracted position when the liquid discharge tube is operatively located within the filling tube of a liquid storage tank with the vapour recovery passage thereof communicating with the tank by way of the shroud, and extendable from the retracted position to the extended position by an extension spring assembly, the improvement of;

(a) a vent valve mounted on and carried by the exterior surface of the wall of the liquid discharge tube and disposed within said shroud, said vent valve having a through passage, an input end, an outlet end and a valve closure member, said valve closure member being movable between a first position closing said through passage and a second position in which said through passage is open, means associated with said vent valve normally urging said valve closure member to said first position, (b) first and second passages opening through said wall of the liquid discharge tube, (c) said vent tube including first and second portions, said first portion having its outer end opening adjacent the outer end of the liquid discharge tube and its inner end communicating with said inlet passage of said vent valve through said first passage of said liquid discharge tube, said second portion having a first end communicating with said outlet passage of said valve through said second passage of said liquid discharge tube and the second end communicating with said vacuum operated release mechanism, (d) said shroud supporting means for engaging said vent valve member to move said valve member between said first and second positions in response to movement of said shroud between said extended position and said retracted position whereby said primary vent passage is closed when said shroud is in said extended position to prevent liquid flow through the liquid discharge tube and said primary vent passage is open when said shroud is in said retracted position such that liquid cannot be discharged through said liquid discharge tube when said shroud is in said extended position.

* * * * *